United States Patent [19]

Strecker

[11] 4,157,177

[45] Jun. 5, 1979

[54] APPARATUS FOR CONVERTING A STREAM OF PARTLY OVERLAPPING SHEETS INTO A STACK

[75] Inventor: Hubert Strecker, Jugenheim, Fed. Rep. of Germany

[73] Assignees: Dr. Otto C. Strecker KG.; Bruderhaus Machinen GmbH, both of Reutlingen, Fed. Rep. of Germany

[21] Appl. No.: 893,832

[22] Filed: Apr. 6, 1978

Related U.S. Application Data

[63] Continuation of Ser. No. 747,508, Dec. 6, 1976, abandoned.

[30] Foreign Application Priority Data

Dec. 10, 1975 [DE] Fed. Rep. of Germany ..... 2555531

[51] Int. Cl.[2] ..... B65H 29/32

[52] U.S. Cl. ..... 271/197; 198/689; 414/77

[58] Field of Search ..... 271/197, 276, 196, 210, 271/221, 96; 214/6 DS; 198/689

[56] References Cited

U.S. PATENT DOCUMENTS

| | | | |
|---|---|---|---|
| 1,279,493 | 9/1918 | Aylard et al. | 271/210 |
| 2,772,880 | 12/1956 | Garrett | 271/197 |
| 3,477,558 | 11/1969 | Fleischauer | 271/197 X |
| 3,477,711 | 11/1969 | Lyman | 271/197 |

FOREIGN PATENT DOCUMENTS

| | | | |
|---|---|---|---|
| 649326 | 8/1937 | Fed. Rep. of Germany | 271/197 |
| 472024 | 9/1937 | United Kingdom | 271/221 |

*Primary Examiner*—Bruce H. Stoner, Jr.
*Attorney, Agent, or Firm*—Peter K. Kontler

[57] ABSTRACT

The upper reach of a first belt conveyor delivers a stream of partly overlapping sheets to one end of a perforated second belt conveyor whose lower reach is located above the open top of a magazine and below the perforated bottom wall of a suction chamber. The lower reach attracts the non-overlapped leaders of successive foremost sheets of the stream and transports them toward a position of register with the open top of the magazine. Timely separation of sheets which are attracted to the underside of the lower reach is insured by a non-foraminous slide which is installed between the suction chamber and the lower reach and is movable lengthwise of the lower reach to seal a selected number of perforations in the lower reach in the region of that side wall of the magazine which is remote from the first conveyor.

2 Claims, 2 Drawing Figures

APPARATUS FOR CONVERTING A STREAM OF PARTLY OVERLAPPING SHEETS INTO A STACK

This is a continuation of application Ser. No. 747,508, filed Dec. 6, 1976, now abandoned.

BACKGROUND OF THE INVENTION

The present invention relates to apparatus for stacking flexible sheets which consist of paper or the like, and more particularly to improvements in apparatus for converting a stream of partially overlapping sheets into a pile wherein the sheets are accurately stacked on top of each other.

Sheets which are obtained by severing a continuous web of paper or the like at regular intervals are normally assembled into stacks for further processing in printing plants or in other types of establishments. In many instances, the sheets which are separated from the leader of a continuous web by a suitable knife are assembled into a stream of partly overlapping sheets to reduce the speed of forward movement of sheets and to thus facilitate accurate stacking of sheets on top of each other. The formation of a stream of partly overlapping sheets is particularly desirable when the frequency at which the web is severed is very high so that it is necessary to greatly reduce the speed of sheets before they reach a magazine, a platform or an analogous support in or on which the sheets are piled on top of each other. Accurate stacking of sheets is desirable for a number of reasons, e.g., to reduce waste which is a necessary adjunct of secondary treatment (trimming) of stacks wherein the sheets are not in accurate register with each other.

As mentioned above, accurate stacking of sheets can be achieved by reducing the speed of sheets which approach the stacking station. The aforementioned formation of a stream of partially overlapping sheets is an effective procedure to reduce the speed of sheets between the severing and stacking stations. The speed of sheets cannot be reduced at will because, otherwise, the sheets are likely to come to a full stop ahead of the optimum position of accurate overlap with the preceding sheets. The selection of such speed depends, among other factors, on the weight of sheets and the finish of their surfaces.

German Offenlegungschrift No. 1,461,212 discloses a stacking apparatus wherein the lower reaches or stretches of two conveyor belts travel below the bottom wall of a suction chamber at a level above the stacking station. The bottom wall of the suction chamber has an elongated slot which is flanked by the lower reaches of the belts. Thus, when a sheet is fed to the undersides of the lower reaches of the belts, such sheet is attracted by the suction chamber and is moved forwardly by the two lower reaches. The pressure in the interior of the suction chamber is only slightly less than atmospheric pressure, especially when the sheets are readily flexible, because excessive suction would cause the sheet to flex or bulge and to enter the slot between the belts. Moreover, such flexing or bulging of the sheet into the interior of the suction chamber would interfere with orderly transport of the sheet and would prevent the apparatus from stacking successive sheets with a requisite degree of reproducibility. When a sheet reaches its foremost position, it is mechanically stripped off the lower reaches of the belts by a forked separating device which directs the separated sheet onto the topmost sheet of the stack therebelow.

The just described apparatus is not suited for stacking of readily flexible lightweight sheets because the slot in the bottom wall of the suction chamber invariably causes at least some deformation of readily flexible sheets and also because the mechanical separating device often or invariably deforms the leading edges of the sheets during stripping off the lower reaches of the belts. If the pressure in the suction chamber is only slightly less than atmospheric pressure, so that the slotted bottom wall of the suction chamber is unlikely to deface or deform the sheets, the apparatus is incapable of insuring proper transport of each and every sheet all the way into the range of the mechanical separating device.

SUMMARY OF THE INVENTION

An object of the invention is to provide a novel and improved apparatus which can convert a stream of sheets into a stack without any damage to and/or defacing of central and/or marginal portions of sheets, which can be used for stacking of relatively stiff or readily flexible and relatively heavy or lightweight sheets, and which can be used as a simpler, more reliable and more versatile substitute for conventional stacking apparatus.

Another object of the invention is to provide an apparatus wherein successive sheets of a stream, particularly a stream of partly overlapping sheets, can be converted into stacks with a heretofore unmatched degree of reproducibility, even if the sheets are fed to the stacking station at an elevated speed and even if the sheets are readily deformable due to the nature of their material and/or low specific weight.

A further object of the invention is to provide the apparatus with novel and improved means for regulating the force with which successive sheets are held during transport to the stacking station and for regulating the locus of application of such force.

An additional object of the invention is to provide the apparatus with novel and improved means for advancing the sheets of a continuous stream of partially overlapping sheets to the stacking station.

The invention is embodied in an apparatus for converting a stream of partially overlapping sheets, particularly paper sheets, into a stack of fully overlapping sheets. The apparatus comprises a support for the stack of sheets (such support may constitute a platform or a magazine), at least one endless perforated conveyor (e.g., an endless foraminous belt) having an elongated lower reach or stretch which is disposed above the support, means for driving the conveyor so as to advance the lower reach in a direction from one toward the other end of the lower reach, a suction chamber or analogous means for establishing a pressure differential between the upper side and the underside of the lower reach with the lower-pressure region located above the lower reach, means for feeding a stream of partially overlapping sheets to the one end of the lower reach whereby the lower reach attracts successive foremost sheets of the stream to its underside and advances the thus attracted sheets toward a position of register with the support, and a sealing plate or analogous means for varying the length (and preferably the location) of that portion of the lower reach of the conveyor which attracts the sheets to the underside of the lower reach. This renders it possible to pinpoint the locus where the sheets become separated from the lower reach as well as the timing of separation. Each of the thus separated sheets can advance toward an optimum position relative to the support due to its inertia, due to frictional engagement with the next-following sheet and/or under the action of the feeding means.

The sealing plate is preferably disposed between the foraminous bottom wall of the suction chamber and the lower reach of the conveyor and is preferably provided with a handle or analogous means for moving it lengthwise of the lower reach.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
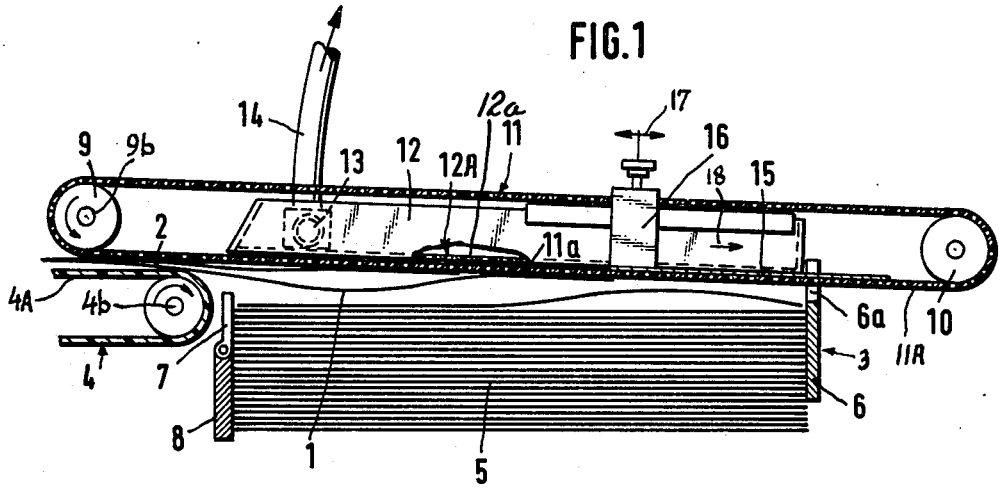
FIG. 1 is a fragmentary longitudinal vertical sectional view of an apparatus which embodies the invention.

Referring to FIG. 1, there is shown an apparatus which serves to convert a continuous stream 2 of partially overlapping flexible paper sheets 1 into a stack 5 wherein the neighboring sheets are in accurate register with each other. The apparatus comprises a support 3 which defines the stacking station and constitutes a magazine having a front side wall 8 which is vibrated by a shaker of conventional design, a rear side wall 6 which is remote from the stream 2, at least one lateral side wall (see the side walls 6*a*, 8*a* shown in FIG. 2) which is vibrated by a shaker (not shown) similar or analogous to the aforementioned shaker, and a stationary or mobile bottom wall (not shown) on which the lowermost sheet 1 of the stack 5 rests. The reference character 7 denotes an oscillating jogger.

Figure 2:
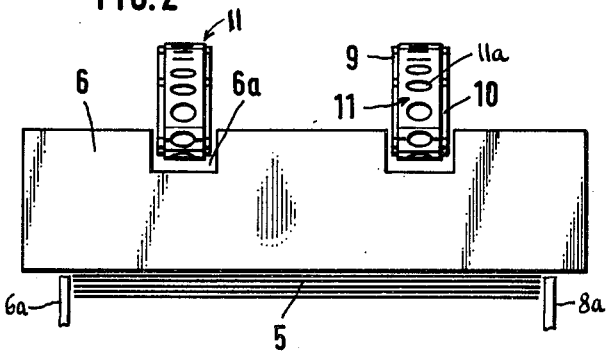
FIG. 2 is an enlarged fragmentary end elevational view of the apparatus as seen from the right-hand side of FIG. 1.

The apparatus further comprises two endless conveyors here shown as perforated belts 11 (see FIG. 2) each having a slightly inclined lower reach 11A which is longer than the distance between the side walls 6, 8 and is disposed above the support 3. The perforations of the belts 11 are shown at 11*a*. FIG. 2 shows that the perforations 11*a* may but need not be identical, i.e., they may include circular, oval and/or otherwise configurated holes.

The means for feeding the stream 2 to the left-hand ends of the lower reaches 11A of the belts 11 comprises at least one endless belt or chain conveyor 4 driven by suitable prime mover means, not shown, to advance the stream-supporting upper reach 4A in a direction to the right, as viewed in FIG. 1. The means for driving the conveyor 4 includes a shaft 4*b* which is rotated in the direction indicated by arrow. The belts 11 are driven at the speed of the conveyor 4 by a shaft 9*b* which drives one of the pulleys 9, 10 for the respective belts. It will be noted that the lower reaches 11A of the belts 11 are driven to advance in the same direction as the upper reach 4A of the conveyor 4. The latter can receive sheets 1 from a severing station at which the leader of a continuous paper web is severed at regular intervals by a knife, not shown.

The lower reaches 11A of the belts 11 pass through suitable cutouts or openings 6*a* in the upper portion of the side wall 6.

The means for establishing a pressure differential between the upper sides and the undersides of the lower reaches 11A comprises a suction chamber or suction box 12 which has a foraminous bottom wall 12A disposed immediately above or very close to the upper sides of the lower reaches 11A. The perforations of the bottom wall 12A are shown at 12*a*. The perforations 12*a* form two rows each of which is aligned with the row of perforation 11*a* in the respective belt 11. The bottom wall 12A can have more than two rows of perforations 12*a*, and the combined number of rows of perforations 11*a* may but need not equal the number of rows of perforations 12*a*. The suction chamber 12 has an outlet 18 which is connected with a suitable suction generating device (e.g., a fan, not shown) by a conduit 14 which may constitute a flexible hose.

In accordance with a feature of the invention, the apparatus further comprises a non-permeable device 15 serving to vary the length and locus of that portion of each lower reach 11A which attracts the adjacent sheet 1 during transport along the open top of the support 3 and toward the rear side wall 6. The device 15 is a thin plate-like slide which is mounted between the bottom wall 12A and the upper sides of the lower reaches 11A and has a handle 16 or analogous means for moving it lengthwise of the belts 11 (see the arrow 17 in FIG. 1). The slide 15 is shiftable to select the length of those portions of lower reaches 11A which attract successive sheets 1 during transport in the direction indicated by arrow 18.

It will be noted that the slide 15 overlies the lower reaches 11A in the region of the rear side wall 6, i.e., at that side of the support 3 which is remote from the feeding conveyor 4. Since the trailing portions of foremost sheets 1 of the stream 2 are overlapped by the next-following sheets of the stream, the slide 15 cooperates with each next-following sheet to determine the length of that interval during which the leader of the foremost sheet 1 of the stream is attracted to the undersides of the lower reaches 11A. When the leader of the foremost sheet 1 begins to move under the slide 15, it is not attracted to the lower reaches 11A and can descend toward the uppermost sheet of the stack 5 in the support 3. The final stage of movement of such sheet toward the rear side wall 6 takes place due to inertia, due to friction with the next-following sheet and/or due to engagement with the upper side of the upper reach 4A of the feeding conveyor 4.

If the sheets 1 fail to reach the rear side wall 6 and/or if the leading edges of the sheets are deformed or defaced on impact against the inner side of the side wall 6, the attendant simply changes the position of the slide 15 to thereby change the length of those portions of the lower reaches 11A which attract the foremost sheets of the stream 2. The progress of successive sheets 1 toward the side wall 6 can be observed from one or more sides of the support 3 and/or from above so that the attendant can immediately terminate the adjustment of slide 15 when the operation of the apparatus is satisfactory. The slide 15 actually determines the number of perforations 12*a* which are free to draw air through the adjacent portions of the lower reaches 11A. It is clear that the slide 15, or an analogous device for varying the effective length of lower reaches 11A, can be installed in the interior of the suction chamber 12 or below the lower reaches of the belts 11. The illustrated mounting is preferred because it does not present problems in connection with sealing of the chamber 12 and also because the slide 15 does not interfere with forward progress of sheets 1 along the undersides of the lower reaches 11A. Moreover, the slide 15 is readily accessible for inspection, cleaning and/or replacement. For example, the entire slide, together with the handle 16, can be inserted into or withdrawn from the space between the bottom wall 12A and lower reaches 11A by moving the handle at right angles to the plane of FIG. 1.

The number of belts 11 can be refunded to one or increased to three or more. It has been found that, in most instances, two perforated belts suffice to insure satisfactory transport of sheets into full register with the uppermost sheet of the stack 5.

An important advantage of the improved apparatus is that the effective length of the lower reaches 11A of belts 11 can be varied at will in a very simple way and also that the sheets 1 are neither damaged nor defaced during transport from the feeding conveyor 4 onto the stack 5. This is due to the fact that the sheets do not contact the suction chamber 12 at any time and also that (at least in the illustrated embodiment) the sheets cannot come into contact with the normally stationary slide 15. Therefore, suction in the chamber 12 can be quite pronounced without any damage to or deformation (especially flexing or bulging) of sheets because the dimensions of perforations **12*a* are of no consequence since the sheets adhere to the undersides of the lower reaches 11A and the intervals of full or nearly full alignment (if any) of perforations 11*a* with the perforations 12*a* thereabove are so short that the sheets cannot be drawn into the perforations 12*a* during travel toward the rear side wall 6. In fact, and if the perforations 11A are rather small, the bottom wall 12A of the suction chamber 12 (in the regions above the lower reaches 11A**) can be formed with perforations in the form of elongated slots.

In many instances, the apparatus of the present invention can be used for simultaneous transport of two or more fully or nearly fully overlapping sheets toward the stacking station. For example, if the sheets are relatively thin and porous, suction in the chamber 12 will suffice to enable the lower reaches 11A to transport two or more fully or nearly fully overlapping sheets from the feeding conveyor 4 toward the rear side wall 6 of the support 3.

Another important advantage of the improved apparatus is that it prevents buckling of sheets 1 during transport from the conveyor 4 toward the side wall 6. This will be readily appreciated by bearing in mind that the speed of the lower reaches 11A preferably equals or closely approximates the speed of the upper reach 4A and that (when the sheets are not overly porous and partially overlap each other) the lower reaches 11A attract only the leader of each foremost sheet, i.e., that portion of such foremost sheet which extends beyond the next-following sheet of the stream 2. Therefore, the sheets remain flat and their leaders begin to move downwardly toward abutment with the side wall 6 only when they reach the region below the slide 15. The side wall 6 invariably intercepts the foremost sheets of the stream 2 because it extends to a level above the lower reaches 11A.

If the discharge end of the conveyor 4 is so remote from the side wall 6 that the conveyor 4 cannot push the foremost sheets of the stream 2 all the way into contact with the side wall 6, the apparatus may comprise a roller (not shown) which is adjacent to the outer side of the front side wall 8 and serves to advance successive foremost sheets of the stream 2 upon termination of transport of such sheets by the lower reaches 11A of the belts 11.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

What is claimed is:

1. Apparatus for converting a stream of flexible sheets, particularly paper sheets, wherein the trailing portion of each preceding sheet is overlapped by the leader of the next-following sheet, into a stack of fully overlapping sheets, comprising a support for the stack of sheets, said support including a member against which the leaders of the sheets in the stack abut; at least one endless perforated conveyor having an elongated lower reach above said support; means for driving said conveyor to thereby move said lower reach in the direction from the one toward the other end thereof; a suction chamber disposed above said lower reach and having a foraminous bottom wall adjacent said lower reach; means for feeding the stream to said one end of said lower reach whereby the underside of said lower reach attracts the leaders of successive sheets of the stream and advances the thus attracted sheets toward a position of register with said support; and means for varying the effective length of that portion of said lower reach which attracts the leaders of successive sheets to said underside thereof, including a non-permeable sealing device disposed between said bottom wall and said lower reach and abutting against said bottom wall to seal the adjacent portion of said lower reach from the interior of said suction chamber, said sealing device extending beyond said member of said support toward said one end of said lower reach to overlie a portion of the stack adjacent to said member so that the leaders of successive sheets are free to become separated from said lower reach before such leaders reach said member of said support.

2. Apparatus as defined in claim 1, further comprising means for moving said sealing device lengthwise of said lower reach.

* * * * *